United States Patent [19]

Lee et al.

[11] 4,011,116

[45] Mar. 8, 1977

[54] CARBON DIOXIDE LASER FUELS

[76] Inventors: Lester A. Lee, 405 River Wood Drive, Oxon Hill, Md. 20022; Edward E. Baroody, 189 Bucknell Road, Bryans Rd., Md. 20616

[22] Filed: Dec. 6, 1974

[21] Appl. No.: 530,260

[52] U.S. Cl. ..... 149/46; 149/45; 149/74; 149/75; 149/76; 149/83; 149/88

[51] Int. Cl.[2] ..... C06B 31/28

[58] Field of Search ..... 149/45, 75, 23, 92, 149/46, 76, 74, 83, 85

[56] References Cited

UNITED STATES PATENTS 3,173,921 3/1965 Einberg ..... 149/23

*Primary Examiner*—Stephen J. Lechert, Jr.

[57] ABSTRACT

Gas dynamic and hybrid gas dynamic-transfer chemical laser systems are achieved by burning halogenated or deuterated tetrazoles in the presence of an oxidizer.

13 Claims, No Drawings

CARBON DIOXIDE LASER FUELS

The invention described herein may be manufactured and used by or for the Government of the United States of America for Governmental purposes without the payment of any royalites thereon or therefor.

BACKGROUND OF THE INVENTION

This invention relates to lasers, and more particularly to a haolgenated or deuterated tetrazole suitable for use as a fuel to generate a laser of the gas dynamic transfer chemical type.

Laser is an acronym for light amplifications by stimulated emission of radiation. A laser produces a beam in the spectral region broadly defined as optical. The laser beam is coherent electromagnetic radiation having a particular well defined frequency. Coherence is a unique feature of the laser because the optical range which includes the near ultraviolet, the visible, and infrared wave lengths is incoherent. So ordinary light is incoherent while lasers are coherent. Because of coherence, lasers have extremely small divergence and are highly directional. Also enormous power is generated in a very small wavelength range. This power can be focused on a spot having a diameter of the wavelength itself, and is capable of producing from a 50 kilowatt outburst a radiant power density of $10^{12}$ watts per square centimeter which is about $10^8$ times the power density at the surface of the sun. Such power has many uses such as testing materials, welding, drilling or military applications. Because of the power produced, much research has been directed to the laser field.

There are two basic types of lasers known as the solid state laser and the gas laser. The solid state laser has a low energy when compared to the gas laser, because it produces a laser beam by electronic excitation of crystalline materials and is a rather complex system, as exemplified by the ruby laser. Due to the lower energy, coherence is an important feature of the laser beam produced in the solid state laser. Gas lasers, on the other hand, have such relatively high energy that coherence is neither achieved as well nor made as important in the lower energy solid state laser.

There are three basic types of gas lasers. Electric discharge, gas dynamic, and chemical lasers are known types of gas lasers. The basic physical process common to them is the competition between stimulated emission and absorption of monochromatic radiation, where the radiation energy corresponds to the difference between two distinct energy levels of an atomic or molecular system. In chemical lasers, the products of highly energetic chemical reactions are formed directly in vibrationally or electrically excited states with the upper levels preferentially populated. In gas dynamic lasers, an initially hot gas in thermodynamic equilibrium is rapidly expanded through a supersonic nozzle, and an inversion is formed by differential relaxation processes in the non equilibrium nozzle flow. In electric discharge lasers, the upper energy level is preferentially populated by collisions with electrons within a gas mixture energized by an electric field.

The laser effect in electric discharge lasers is produced by funneling the gas through an electric field to achieve the desired excited level and produce a laser beam. High energy levels are required to excite the gas to laser producing levels.

Chemical lasers depend on a carefully monitored flow of gases which intersect at precisely the right point at the precise angle with the desired velocity at the right temperature to react to produce the desired laser characteristics. These parameters are only a few of the parameters which must be controlled in order for a chemical laser to function. Controls on each of the parameters are highly complicated in themselves and must be integrated with other complicated controls to produce the laser beam. All of these complications substantially affect the use of the chemical laser.

Simplest of the three types of lasers to use is the thermal or gas dynamic laser. This laser produces the laser beam by means of a rapid gas expansion. This type of laser is simplest to handle because the reactants are generally solid or liquid and easier to handle and store. However, finding reactants to produce laser action is difficult.

Laser action occurs when two conditions are met: (1) population inversion is achieved and (2) avalanche process of photon amplification is established in a suitable cavity. Population inversion is established in an atomic system having at least one ground level, and at least two excited levels wherein one of the excited levels has a longer spontaneous emission lifetime than the other excited level. Inversion permits stimulated emission to exceed absorbtion which results in photon amplification. A more thorough discussion of laser action is found in U.S. Pat. No. 3,543,179 to Wilson incorporated herein by reference.

In spite of the difficulties involved in achieving a laser beam, the power of the laser beam renders the field highly fertile for research. Some of the areas most fertile are those which simplify the generation of a laser beam. The above-mentioned electrical discharge lasers, chemical lasers, and gas dynamic lasers are highly complex means of generating the desired laser beam. Efforts in the thermal laser field are made because of the simple operation. However, thermal generation of a laser beam is difficult. Chemical gas generation is a well-known method of simplifying a gas laser-generation process. The problem now becomes selecting an appropriate fuel or chemical which produces the proper gas for rapid thermal expansion when reacted or burned.

It is possible to pump gas dynamic lasers by use of hydrocarbon/air mixtures. These mixtures are ignited in a combustion chamber and then allowed to expand through a supersonic nozzle so that population inversion occurs. Theoretically, the efficiency of the laser increases with increasing combustion pressure and temperature, and with increasing expansion ratio. The combustion products must contain a high percentage of nitrogen, and approximately 10% to 15% carbon dioxide, and some percentage of water vapor. In addition, the combustion products should not contain any solid particles or highly corrosive gases; however, gases such as carbon monoxide and oxygen do not seem to be detrimental to the optical gain. These requirements rule out the use of conventional explosives such as trinitrotoluene, nitrocellulose, and the like, as well as double-base and composite propellants. For military applications, lasers must meet rigid requirements such as safety, storage, handling, and non-toxicity.

Additionally, for military applications, only solid propellants are considered to generate the laser gases mentioned above. The propellant would consist of only the elements carbon, hydrogen, oxygen, and nitrogen. However, solid organic compounds that can produce high nitrogen, low carbon dioxide and water upon burning are usually unstable, toxic, and hard to store, especially in large quantities. They also have high combustion temperatures that are difficult to use with laser equipment.

Gas dynamic and chemical lasers are similar in that both depend upon competition between stimulated emission and radiationless relaxation processes. Several publications have described the operation of gas dynamic lasers by the combustion of fuel-oxidizer mixtures in a combustion chamber. The hot gases in thermal equilibrium are allowed to expand through a supersonic nozzle so that population inversion occurs. The inverted $N_2$ pumps the $CO_2$.

One disadvantage of the $N_2$—$CO_2$—He GDL is that 60% He with 30% $N_2$ is required for maximum power. Helium acts as a diluent and a relaxant for the $CO_2$ lower laser level. The replacement of He with a more efficient relaxor such as 1% $H_2O$ allows more $N_2$ for pumping. The 89% $N_2$ — 10% $CO_2$ — 1% $H_2O$ system which is one of the best, has the disadvantage of being virtually impossible to generate by the combustion of a non-gaseous fuel and oxidizer. At the present time, most GDLs depend upon bottle or cryogenic gases which is highly complicated.

Continuous wave operation at 10.6 in HCl—$CO_2$, HBr—$CO_2$, DF—$CO_2$ and HF—$CO_2$ chemical lasers are known. The laser emission is believed to be the result of upper $CO_2$ laser level pumped by vibrational-rotational energy transferred from excited HCl, HBr, DF and HF molecules formed by chemical reactions.

In the DF-$CO_2$ system, F. (provided by partial dissociation of $F_2$ by photolysis, thermolysis, reaction of $F_2$ with NO. or thermal dissociation of $SF_6$ or $NF_3$) is mixed with $CO_2$, $N_2$ and $D_2$. The rapid and efficient chain reactions, $F. + D_2 \rightarrow DF^* + D.$ and $D. + F_2 \rightarrow DF^* + F.$ are driven to completion as the mixtures flows along a Teflon reaction tube.

The present chemical laser fuels have a disadvantage in that generation of halogen radicals by thermolysis or photolysis requires the addition of extra equipment such as furnaces or flash lamps.

SUMMARY OF THE INVENTION

Therefore, it is an object of this invention to provide an improved composition to assist in generating a laser beam.

Also it is an object of this invention to provide a composition suitable for use in a thermally pumped laser.

It is a further object of this invention to provide a propellant suitable for use in pumping lasers.

It is a still further object of this invention to provide a simplified method for generating a laser beam.

Another object of this invention is to provide a fuel composition suitable for generating a laser beam.

These and other objects of the invention are met by providing a laser fuel comprising a halogenated or deuterated tetrazole and burning the fuel with an oxidizer to produce a gas which excites at least one molecule of at least one other gas to laser activity.

DESCRIPTION OF THE PREFERRED EMBODIMENT

A gas such as carbon dioxide is excited to laser activity by a gas or gases produced from the burning of at least one tetrazole with at least one oxidizer.

The phenomenon of one gas causing laser activity in another gas is known as the gas dynamic transfer chemical laser. The gas dynamic transfer chemical laser uses non-thermal vibrational energy of chemical reaction products to create a total population inversion in a second molecule such as carbon dioxide, thereby creating a transfer of energy. Further discussion of the phenomenon is found in Cool, "MDI The Transfer Chemical Laser," *IEEE Journal of Quantum Electronics*, Vol QE9, No. 1, January 1973, incorporated herein by reference.

New laser fuels are halogenated and deuterated 5-substituted (I), 1,5-disubstituted (II), 2,5-disubstituted tetrazoles (III) and 1 or 2 mono substituted bitetrazoles (IV):

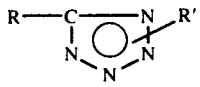

I
where R = X or $X_3C$— and R′ = H or D;

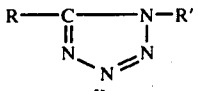

II
where R = $X_3C$— R′ = $D_3C$— or $H_3C$—,

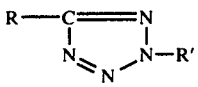

III
where R = $X_3C$— R′ = $D_3C$— or $H_3C$—, and

IV

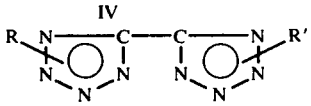

wherein R, R′ = H or D and X = F, Cl, Br and I.

Halogenated and deuterated 1,5 and 2,5-dinitromethyl substituted tetrazoles are alternative fuels of this invention, and have for formulas:

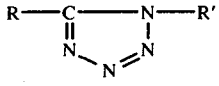

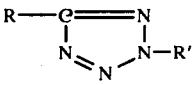

where R = $(NO_2)_2\overset{H}{C}$—, $(NO_2)_2\overset{D}{C}$—; and R′ = F, Cl, Br and I.

The above cited fuels or similar compounds are either well-known in the art or made by obvious modifications of standard art methods. U.S. Pat. No. 3,173,921 to Einberg, and U.S. Pat. No. 2,710,297; both patents being incorporated herein by reference; are sources of information on the above cited tetrazoles. Other reference sources on how to make the tetrazoles used in this invention, incorporated herein by reference, are Norris, 5"-Trifluoromethyltetrazole and Its Derivatives," Journal Of Organic Chemistry, Volume 27, Page 3248, (1962) Finnegan et al "5-Substituted Tetrazoles," Journal Of The American Chemical Society, Volume 80, Page 3908, (1958); Benson, "The Tetrazoles" Chemical Review, Volume 41, Page 1, (1947); and Benson Heterocyclic Compounds, Volume 8, Page 1, (1967).

The combustion of the new fuels with oxidizers such as $N_2O$, Air, $KClO_4$, $NH_4ClO_4$, $NH_4NO_3$, $ND_4ClO_4$, $ND_4NO_3$ etc. to give hot mixtures of $N_2$—$CO_2$—DX-$D_2O$ or $N_2$—$CO_2$—HX—$H_2O$ should generate maximum electromagnetic radiation of 10.6 when expanded through a supersonic nozzle. DX is more efficient than HX in pumping $CO_2$ laser. The D, of course, refers to the hydrogen isotope deuterium.

Storable liquid fuels such as 5-fluorotetrazole, 1-methyl-5-trifluoromethyl and 2-methyl-5-trifluorotetrazole, are quite suitable for Air-Breathing Gas Dynamic Lasers and Gas Dynamic Lasers utilizing $N_2O$ as the oxidizer.

5-Trifluoromethyltetrazole is a suitable fuel for a hybrid Gas Dynamic - Transfer Chemical Laser. After combustion of 5-trifluoromethyltetrazole with air or $N_2O$, the supersonic exhaust gases containing (2F. → $F_2$) are mixed with $D_2$ which react to form excited DF* that pumps the $CO_2$. This pumping augments thermally excited DF* and $N_2$* molecules.

The following example is intended to illustrate without unduly limiting the invention. All parts and percentages are by weight unless otherwise specified.

EXAMPLE I

The combustion products of several formulations predicted by a standard rocket motor performance computer program are presented in Table I.

TABLE I

| Components | I | II | III | IV | V | VI | VII | VIII | IX | X |
|---|---|---|---|---|---|---|---|---|---|---|
| LASER FUEL COMPOSITIONS AND THEORETICALLY COMPUTED REACTION PRODUCTS AT 1000 psi | | | | | | | | | | |
| FT | 36.78 | 50.00 | — | — | — | — | — | — | — | — |
| TFMT | — | — | 31.33 | 43.94 | 31.19 | 36.04 | 47.91 | 43.66 | — | — |
| MTFMT | — | — | — | — | — | — | — | — | 25.09 | 36.54 |
| Air | 63.22 | — | 68.67 | — | 68.36 | 59.26 | — | — | 74.91 | — |
| $N_2O$ | — | 50.00 | — | 56.06 | — | — | 45.83 | 55.70 | — | 63.46 |
| $H_2$ | — | — | — | — | 0.45 | — | — | 0.64 | — | — |
| $H_2O$ | — | — | — | — | — | 4.70 | 6.26 | — | — | — |
| GASEOUS REACTION PRODUCTS (MOLE %) | | | | | | | | | | |
| $CO_2$ | 9.59 | 6.00 | 13.30 | 17.06 | 12.06 | 14.51 | 14.60 | 9.89 | 13.73 | 11.70 |
| CO | 2.36 | 9.66 | — | 1.05 | 0.78 | 0.40 | 4.86 | 7.49 | 0.66 | 8.65 |
| $N_2$ | 74.45 | 61.27 | 69.96 | 54.21 | 67.40 | 62.48 | 48.09 | 51.22 | 70.79 | 53.23 |
| HF | 11.80 | 14.54 | 6.65 | 9.06 | 19.10 | 22.33 | 28.72 | 25.22 | 14.35 | 19.55 |
| $H_2O$ | 0.05 | 0.20 | — | — | — | 0.01 | 0.16 | 0.24 | 0.02 | 0.20 |
| F. | 0.15 | 1.13 | 6.83 | 17.83 | 0.16 | 0.03 | 0.47 | 0.85 | 0.04 | 0.81 |
| $F_2$ | — | — | 3.24 | 0.14 | — | — | — | — | — | — |
| H. | 0.01 | 0.18 | — | — | — | — | 0.02 | 0.07 | — | 0.07 |
| $H_2$ | — | 0.04 | — | — | — | — | 0.01 | 0.03 | — | 0.02 |
| NO. | 0.74 | 2.78 | — | 0.27 | — | 0.10 | 1.11 | 1.86 | 0.19 | 2.12 |
| $O_2$ | 0.74 | 2.49 | — | 0.48 | 0.23 | 0.14 | 1.64 | 2.26 | 0.23 | 2.70 |
| HO. | 0.04 | 0.47 | — | — | 0.27 | — | 0.14 | 0.32 | 0.01 | 0.31 |
| Total Moles of Gas | 3.495 | 3.625 | 3.411 | 3.515 | 3.519 | 3.502 | 3.567 | 3.639 | 3.440 | 3.541 |
| Chamber, $T_r$(° K) | 2837 | 3617 | 1526 | 2476 | 2450 | 2255 | 3020 | 3321 | 2381 | 3343 |

FT = 5-Fluorotetrazole; TFMT = 5-Trifluoromethyltetrazole, bp. 81–82° (5mm), $d^{250}$1.578; MTGMT = 1-Methyl-5-Trifluoromethyltetrazole, b.p. 101–120° (46mm), m.p. −30° to −29°, $d^{25}$1.445.

The new fuels cited in this invention depending upon their physical properties (liquid or solid) are suitable for (1) an Air-Breathing gas dynamic laser (GDL), (2) a Nitrogen Augmented GDL, (3) a Gas-Liquid Injection GDL, (4) a Liquid Injection GDLs, (5) Solid Propellant GDL, and gas dynamic transfer chemical lasers.

Charges can be fired in rapid succession when a revolver/machine gun type arrangement is used. Firing of the charges is initiated by any standard means, e.g., blasting cap. The propellant or explosive charge is formed by either with or without a binder. Mechanical stability may be inherent from the fuel and oxidizer, or a binder may provide the stability. Suitable binders are listed in U.S. Pat. No. 3,375,230 to Oja et al incorporated herein by reference. Depending on compatibility and physical condition of the ingredients, the charge can be premixed or mixed (injected) inside the combustion chamber.

The combustion products are then expanded through a supersonic nozzle, such as that described in U.S. Pat. No. 3,560,876 to Airey incorporated herein by reference, in order to produce the laser beam. Use of a nozzle usually requires that the combustion products be substantially gaseous. Modification of the laser producing system is required if solid products are part of the combustion gases.

Compatibility tests between the fuels and oxidizers are run using standard techniques. These tests are required because of the explosive nature and sensitivity of some compounds and mixtures thereof. In this manner, the safety of fuel and oxidizer combinations is determined.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A composition capable of generating a laser beam when subjected to combustion in a gas dynamic-chemical transfer laser, said composition comprising a halogenated or deuterated compound selected from the group consisting of a. a 5-substituted tetrazole;
b. a 1,5-disubstituted tetrazole;
c. a 2,5-disubstituted tetrazole;
d. a 1-monosubstituted bitetrazole;
e. a 2-monosubstituted bitetrazole;
f. a 1,5-dinitromethyl substituted tetrazole; and
g. a 2,5-dinitromethyl substituted tetrazole, and an oxidizer selected from the group consisting of air, $N_2O$, $KClO_4$, $NH_4ClO_4$, $NH_4NO_3$, $ND_4ClO_4$, $ND_4NO_3$ and mixtures thereof.

2. The composition of claim 1 wherein the oxidizer is selected from the group consisting of air and $N_2O$.

3. The composition of claim 2 wherein the 5-substituted tetrazole has the formula:

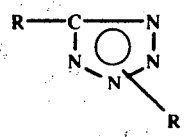

where R is X or $X_3C$,
and R′ is H or D,
and where X is F, Cl, Br or I.

4. The composition of claim 2 wherein the 1,5-disubstituted tetrazole has the formula

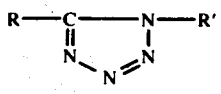

wherein R is $X_3C$ and R′ is $D_3C$ or $H_3C$ and where X is F, Cl, Br and I.

5. The composition of claim 2 wherein the 2,5-disubstituted tetrazole has the formula

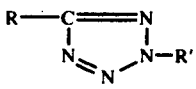

where R is $X_3C$ and R′ is $D_3C$ or $H_3C$
and where X is F, Cl, Br, or I.

6. The composition of claim 2 wherein the 1-monosubstituted bitetrazole has the formula

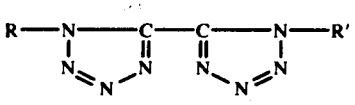

wherein R and R′ are selected from the group consisting of
H, D, and X
wherein X is F, Cl, Br or I.

7. The composition of claim 2 wherein the 2-monosubstituted bitetrazole has the formula

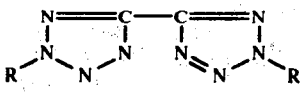

wherein R and R′ are selected from the group consisting of H, D, and X
wherein X is F, Cl, Br or I.

8. The composition of claim 2 wherein the 1,5-dinitromethyl tetrazole has the formula

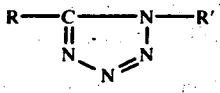

wherein R is selected from the group consisting of

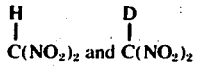

and R′ is selected from the group consisting of F, Cl, Br, and I.

9. The composition of claim 2 wherein the 2,5-dinitromethyl tetrazole has the formula

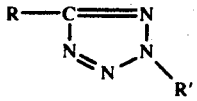

wherein R is selected from the group consisting of

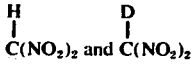

and R′ is selected from the group consisting of F, Cl, Br and I.

10. The composition of claim 3 wherein the fuel is 5-fluorotetrazole.

11. The composition of claim 4 wherein the fuel is 1-methyl-5-trifluoromethyl tetrazole.

12. The composition of claim 5 wherein the fuel is 2-methyl-5-trifluoromethyltetrazole.

13. The composition of claim 3 wherein the fuel is 5-trifluoromethyltetrazole.

* * * * *